US008418938B2

(12) United States Patent
Chen

(10) Patent No.: US 8,418,938 B2
(45) **Date of Patent: *Apr. 16, 2013**

(54) SHOWER HEAD HAVING A LARGER FLUSHING ANGLE

(75) Inventor: Kun-Chih Chen, Changhua Hsien (TW)

(73) Assignee: Sunrise Shower Products Co., Ltd., Changhua Hsien (TW)

( * ) Notice: Subject to any disclaimer, the term of this patent is extended or adjusted under 35 U.S.C. 154(b) by 457 days.

This patent is subject to a terminal disclaimer.

(21) Appl. No.: 12/773,071

(22) Filed: May 4, 2010

(65) Prior Publication Data

US 2011/0272497 A1 Nov. 10, 2011

(51) Int. Cl.
*E03C 1/08* (2006.01)

(52) U.S. Cl.
USPC ..... 239/428.5; 239/104; 239/419.5; 239/425.5; 239/548; 239/587.4; 239/590; 239/600

(58) Field of Classification Search ..... 239/104, 239/106, 419.5, 425.5, 428.5, 548, 552, 587.1, 239/587.4, 589, 590–590.5, 600
See application file for complete search history.

(56) References Cited

U.S. PATENT DOCUMENTS

| | | | | |
|---|---|---|---|---|
| 4,134,548 | A * | 1/1979 | Harmony | 239/428.5 |
| 5,154,355 | A * | 10/1992 | Gonzalez | 239/425.5 |
| 5,381,957 | A * | 1/1995 | Bianco | 239/428.5 |
| 8,191,799 | B2 * | 6/2012 | Chen | 239/587.4 |

* cited by examiner

*Primary Examiner* — Steven J Ganey
(74) *Attorney, Agent, or Firm* — Alan Kamrath; Kamrath IP Lawfirm, P.A.

(57) ABSTRACT

A shower head includes a nozzle, a connector mounted on an open top of the nozzle, a fastening member secured on the open top of the nozzle and abutting the connector to limit the connector on the nozzle, and a bushing mounted in the connector. Thus, when the water flows through the shower head, the ambient air is introduced through the connector and the bushing to break the vacuum state in the shower head and to perturb the water flow in the shower head so as to produce a turbulent flow in the shower head so that the water flow injected from the nozzle is broken and divided into multiple straight water beams and multiple irregular water bubbles so as to increase the flushing angle and area of the shower head.

5 Claims, 6 Drawing Sheets

SHOWER HEAD HAVING A LARGER FLUSHING ANGLE

BACKGROUND OF THE INVENTION

1. Field of the Invention

The present invention relates to a shower head and, more particularly, to a shower head for a bathroom.

2. Description of the Related Art

A conventional shower head 60 in accordance with the prior art shown in FIGS. 5 and 6 comprises a nozzle 63, a connector 62 mounted on an open top of the nozzle 63, a sealing ring 632 mounted in the open top of the nozzle 63 and located between the connector 62 and the nozzle 63, and a fastening member 61 secured on the open top of the nozzle 63 and abutting the connector 62 to limit the connector 62 on the nozzle 63. The nozzle 63 has a peripheral wall provided with a control handle 631 to regulate a water flow injected from the nozzle 63. The open top of the nozzle 63 has an inner portion formed with an inner threaded portion 633. The connector 62 has a first end provided with a spherical body 622 rotatably mounted on the open top of the nozzle 63 and abutting the sealing ring 632 and has a second end provided with a threaded tube 621 that is connected to a water source (not shown). The connector 62 has an inner portion formed with a flow channel 623. The flow channel 623 of the connector 62 has a bottom formed with a reduced water outlet 624. The fastening member 61 has an outer wall formed with an outer threaded portion 612 screwed into the inner threaded portion 633 of the nozzle 63 and has an inner wall formed with a limit hole 611 mounted on the spherical body 622 of the connector 62. In operation, when the threaded tube 621 of the connector 62 is connected to the water source, the water from the water source in turn flows through the flow channel 623 and the water outlet 624 of the connector 62 into the nozzle 63 and is injected outward from the nozzle 63 for use with a user.

However, when the threaded tube 621 of the connector 62 is connected to the water source, a closed vacuum condition is formed in the inner space of the shower head 60 so that the inner space of the shower head 60 has a larger water pressure to push and inject the water from the nozzle 63 quickly and violently to form multiple concentrated and convergent water beams, thereby decreasing the flushing angle and area of the shower head 60. In addition, the water beams are injected outward from the nozzle 63 strongly due to the larger water pressure in the shower head 60, thereby easily causing an uncomfortable sensation to the user.

BRIEF SUMMARY OF THE INVENTION

In accordance with the present invention, there is provided a shower head, comprising a nozzle, a connector mounted on an open top of the nozzle, a sealing ring mounted in the open top of the nozzle and located between the connector and the nozzle, a fastening member secured on the open top of the nozzle and abutting the connector to limit the connector on the nozzle, and a bushing mounted in the connector. The open top of the nozzle has an inner portion formed with an inner threaded portion. The connector has a first end provided with a spherical body rotatably mounted on the open top of the nozzle and abutting the sealing ring and has a second end provided with a threaded tube. The connector has an inner portion formed with a flow channel. The flow channel of the connector has a peripheral wall formed with two radially opposite limit portions. The connector has a peripheral wall formed with two radially opposite air conducting holes. The air conducting holes of the connector are connected to the flow channel. The fastening member has an outer wall formed with an outer threaded portion screwed into the inner threaded portion of the nozzle and has an inner wall having a top formed with a limit hole mounted on the spherical body of the connector. The bushing is received in the flow channel of the connector. The bushing has an outer wall formed with two radially opposite locking portions locked in the limit portions of the connector respectively. The bushing has an inner wall formed with a flow conduit connected to the flow channel of the connector. The bushing has a peripheral wall formed with two radially opposite air conducting apertures aligning with the air conducting holes of the connector respectively. The air conducting apertures of the bushing are connected to the flow conduit.

The primary objective of the present invention is to provide a shower head having a larger flushing angle.

According to the primary objective of the present invention, when the water flows through the shower head, the ambient air is introduced through the air conducting holes of the connector and the air conducting apertures of the bushing into the flow conduit of the bushing to break the vacuum state in the shower head and to perturb the water flow in the shower head so as to produce a turbulent flow in the shower head so that the water flow injected from the nozzle is broken and divided into multiple straight water beams and multiple irregular water bubbles so as to increase the flushing angle and area of the shower head and to enhance the water flushing effect of the shower head.

According to another objective of the present invention, the ambient air is introduced through the air conducting holes of the connector and the air conducting apertures of the bushing into the flow conduit of the bushing to reduce the water pressure in the shower head so that the water is injected from the nozzle smoothly and stably so as to provide a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
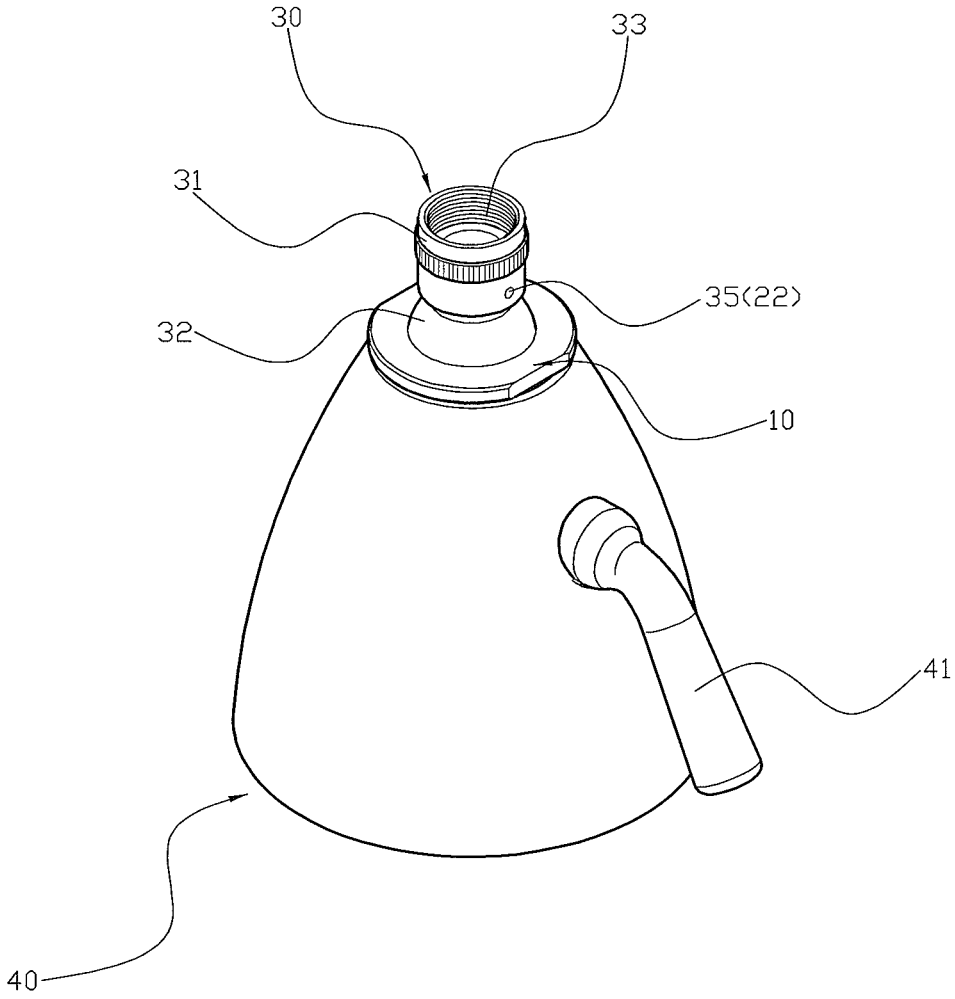
FIG. 1 is a perspective view of a shower head in accordance with the preferred embodiment of the present invention.
Figure 2:
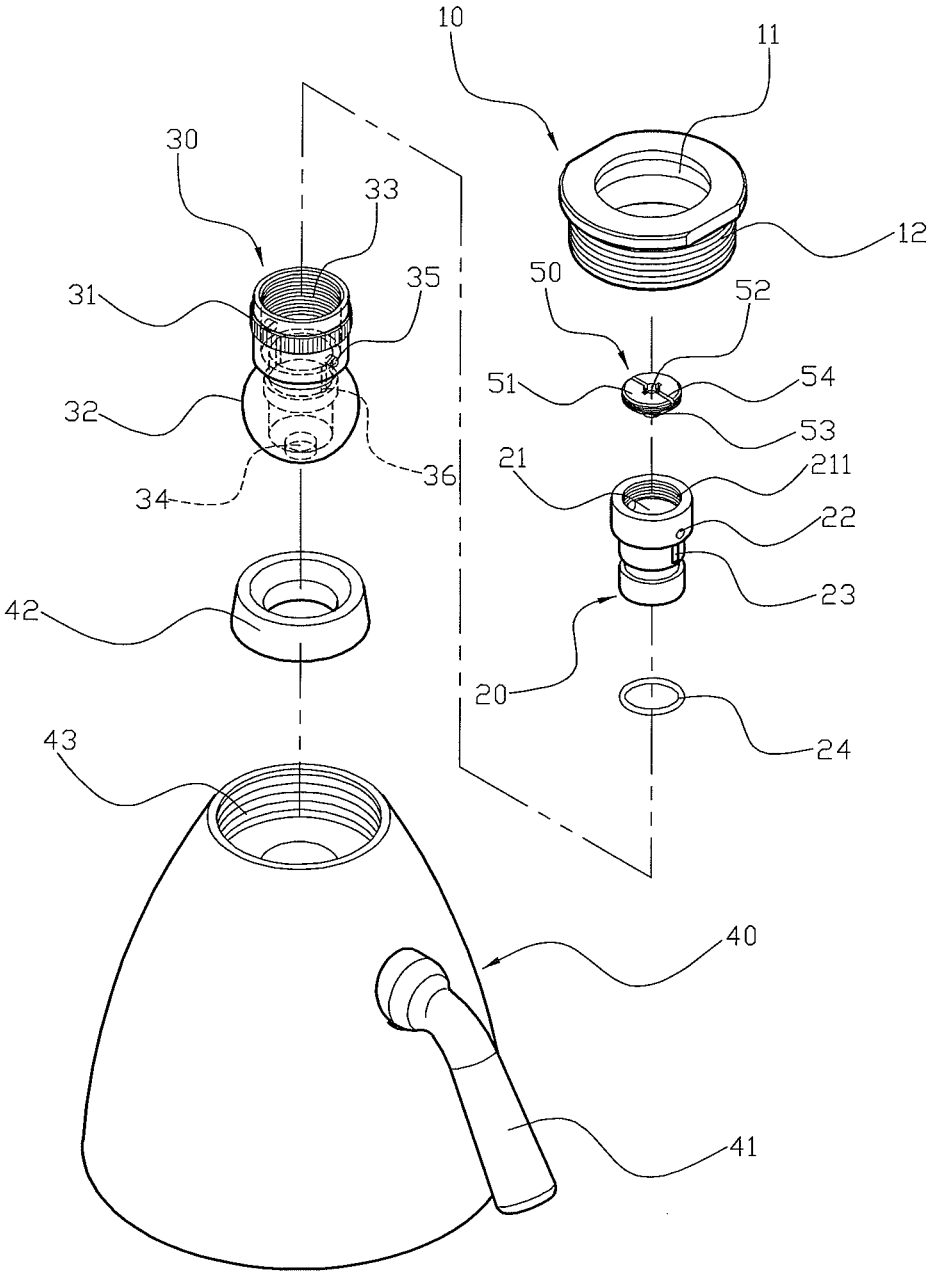
FIG. 2 is an exploded perspective view of the shower head as shown in FIG. 1.
Figure 3:
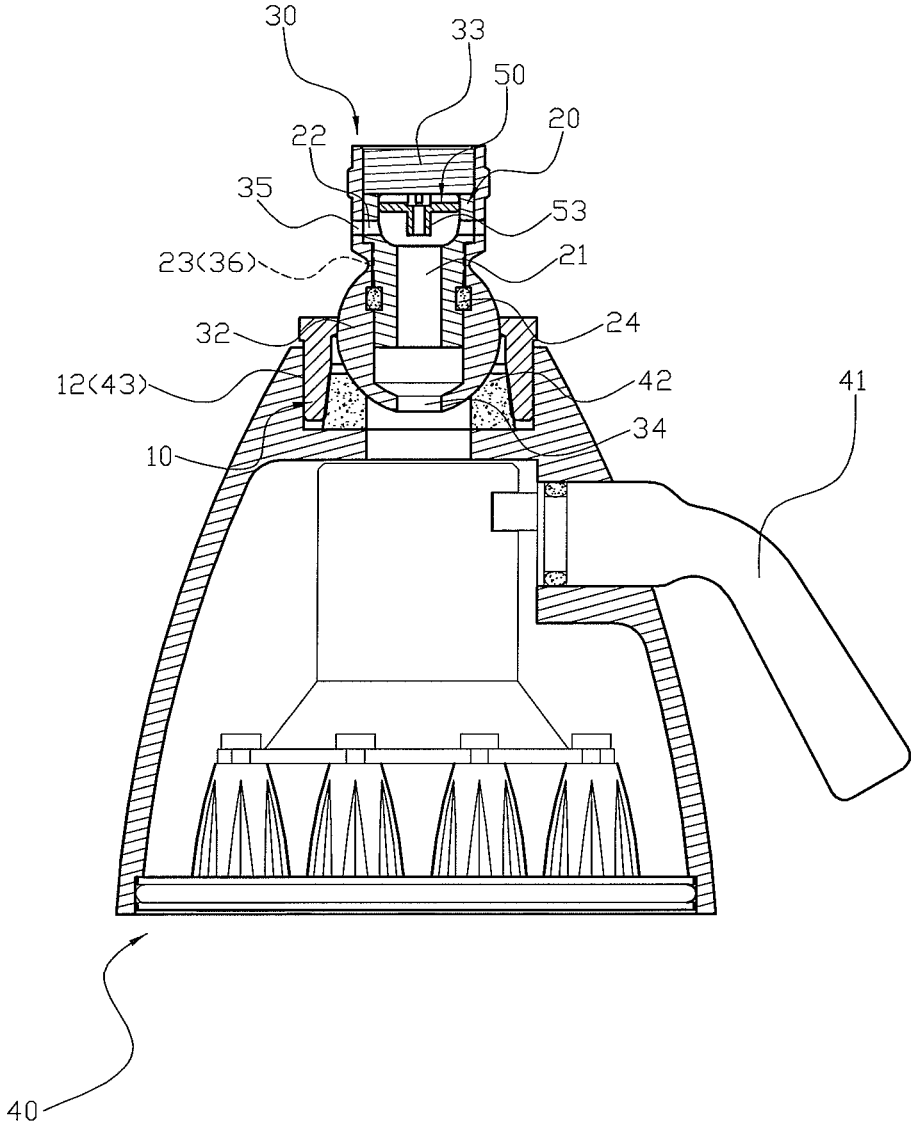
FIG. 3 is a front cross-sectional view of the shower head as shown in FIG. 1.

Referring to the drawings and initially to FIGS. 1-3, a shower head in accordance with the preferred embodiment of the present invention comprises a nozzle 40, a connector 30 mounted on an open top of the nozzle 40, a sealing ring 42 mounted in the open top of the nozzle 40 and located between the connector 30 and the nozzle 40, a fastening member 10 secured on the open top of the nozzle 40 and abutting the connector 30 to limit the connector 30 on the nozzle 40, and a bushing 20 mounted in the connector 30.

The nozzle 40 has a peripheral wall provided with a control handle 41 to regulate a water flow injected from the nozzle 40. The open top of the nozzle 40 has an inner portion formed with an inner threaded portion 43.

The connector 30 has a first end provided with a spherical body 32 rotatably mounted on the open top of the nozzle 40 and abutting the sealing ring 42 and has a second end provided with a threaded tube 31 that is connected to a water source (not shown). The connector 30 has an inner portion formed with a stepped flow channel 33. The flow channel 33 of the connector 30 extends axially through the connector 30 and has a peripheral wall formed with two radially opposite limit portions 36. Each of the limit portions 36 of the connector 30 is an elongate slot which extends axially in the flow channel 33 of the connector 30. The flow channel 33 of the connector 30 has a bottom formed with a reduced water outlet 34 which has a diameter smaller than that of the flow channel 33. The connector 30 has a peripheral wall formed with two radially opposite air conducting holes 35. The air conducting holes 35 of the connector 30 are formed in a peripheral wall of the threaded tube 31 of the connector 30 and are connected to the flow channel 33.

The fastening member 10 has a ring shape. The fastening member 10 has an outer wall formed with an outer threaded portion 12 screwed into the inner threaded portion 43 of the nozzle 40 and has an inner wall having a top formed with a limit hole 11 mounted on the spherical body 32 of the connector 30 so that the threaded tube 31 of the connector 30 protrudes outward from the limit hole 11 of the fastening member 10. The inner wall of the fastening member 10 presses an outer wall of the sealing ring 42.

The bushing 20 is a hollow stepped cylinder that is made of plastic material. The bushing 20 is received in the flow channel 33 of the connector 30. The bushing 20 has an outer wall formed with two radially opposite locking portions 23 locked in the limit portions 36 of the connector 30 respectively so that the bushing 20 is positioned in the flow channel 33 of the connector 30 exactly. The bushing 20 has an inner wall formed with a flow conduit 21 connected to the flow channel 33 of the connector 30. Each of the locking portions 23 of the bushing 20 is an elongate rib which extends axially on the bushing 20. The flow conduit 21 of the bushing 20 extends axially through the bushing 20 and is connected between the flow channel 33 and the water outlet 34 of the connector 30. The flow conduit 21 of the bushing 20 has a circular shape and has an upper end formed with an inner threaded section 211. The bushing 20 has a peripheral wall formed with two radially opposite air conducting apertures 22 aligning with the air conducting holes 35 of the connector 30 respectively. The air conducting apertures 22 of the bushing 20 are connected to the flow conduit 21.

The shower head further comprises an O-ring 24 mounted on the outer wall of the bushing 20 and located in the flow channel 33 of the connector 30. The O-ring 24 is pressed between the bushing 20 and the connector 30 to provide an air-tight effect between the bushing 20 and the connector 30.

The shower head further comprises a top cover 50 secured in the flow conduit 21 of the bushing 20 to seal the flow conduit 21 of the bushing 20. The top cover 50 has a first end provided with a threaded disk 51 screwed into the inner threaded section 211 of the bushing 20 and has a second end provided with a flow tube 53 which is extended into the flow conduit 21 of the bushing 20. The top cover 50 has an inner portion formed with a through hole 52 which is connected between the flow channel 33 of the connector 30 and the flow conduit 21 of the bushing 20. The through hole 52 of the top cover 50 extends axially through the threaded disk 51 and the flow tube 53 of the top cover 50. The top cover 50 has a top face formed with an elongate tool insertion slit 54 to allow insertion of a hand tool (not shown), such as a screwdriver and the like.

Figure 4:
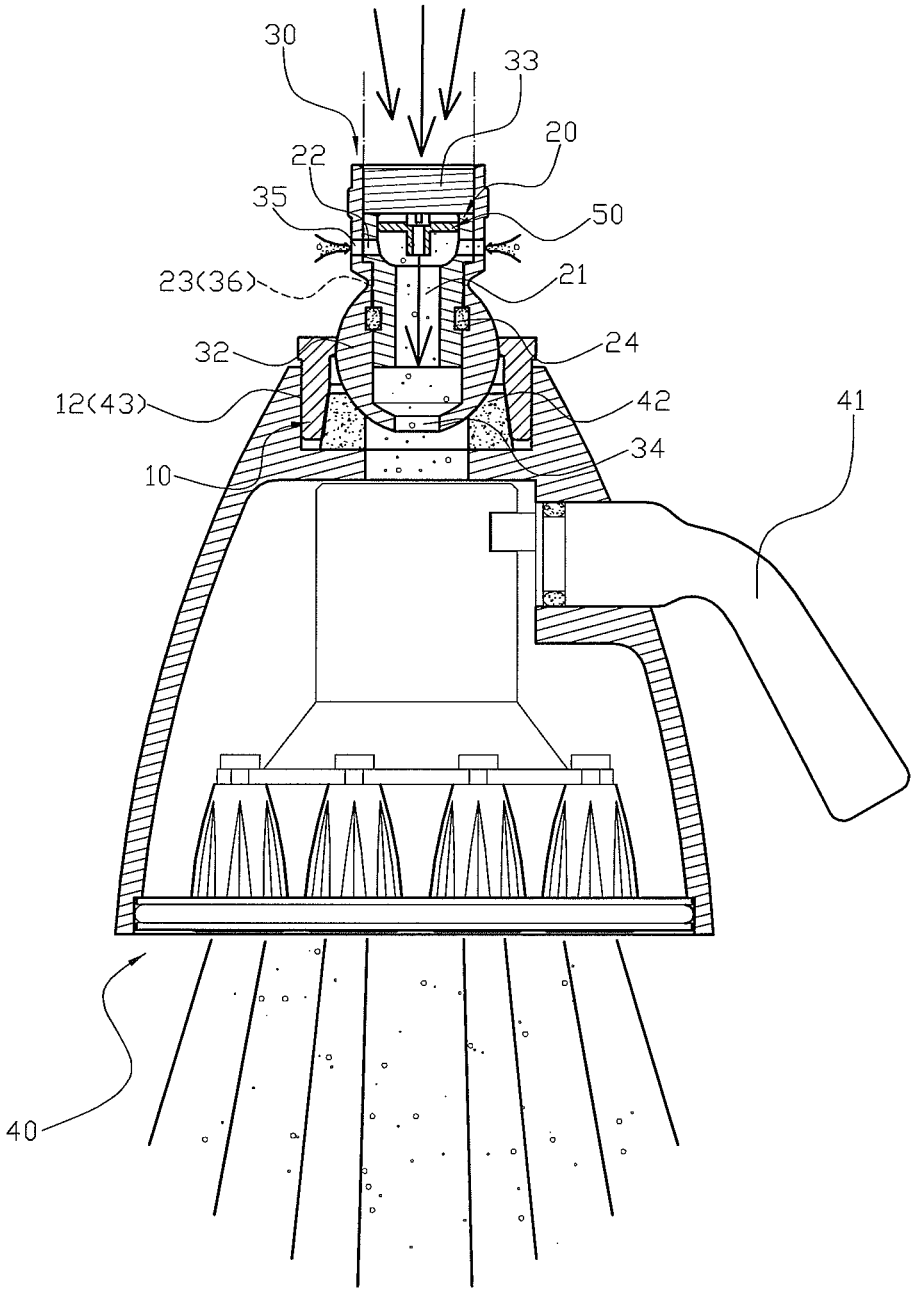
FIG. 4 is a schematic operational view of the shower head as shown in FIG. 3 in use.
Figure 5:
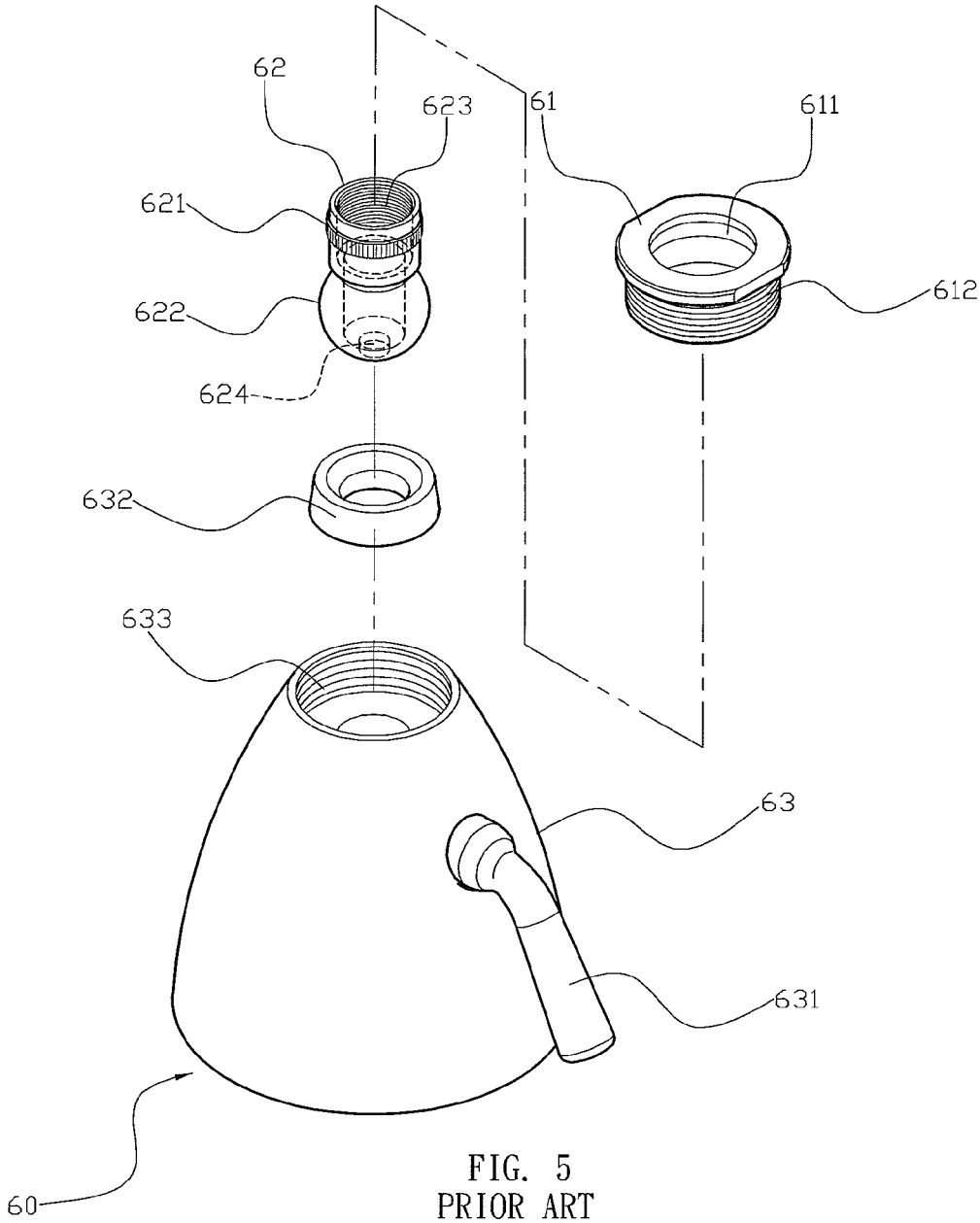
FIG. 5 PRIOR ART
FIG. 5 is an exploded perspective view of a conventional shower head in accordance with the prior art.
Figure 6:
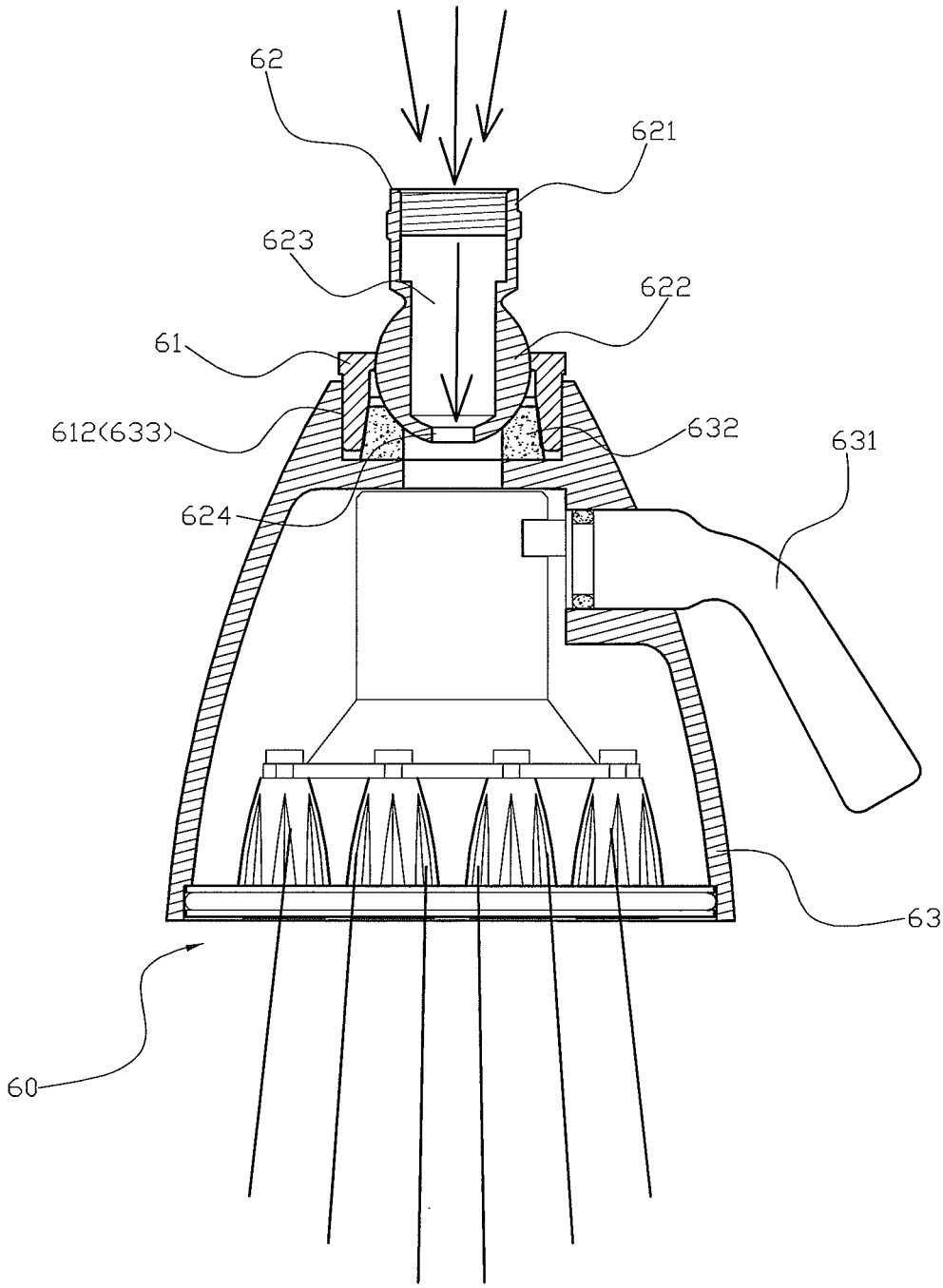
FIG. 6 PRIOR ART
FIG. 6 is a front cross-sectional operational view of the conventional shower head as shown in FIG. 5.

In operation, referring to FIGS. 3 and 4 with reference to FIGS. 1 and 2, when the threaded tube 31 of the connector 30 is connected to the water source, the water from the water source in turn flows through the flow channel 33 of the connector 30, the through hole 52 of the top cover 50, the flow tube 53 of the top cover 50, the flow conduit 21 of the bushing 20 and the water outlet 34 of the connector 30 into the nozzle 40 and is injected outward from the nozzle 40 for use with a user.

At this time, the air conducting apertures 22 of the bushing 20 align with the air conducting holes 35 of the connector 30 respectively so that the ambient air is introduced through the air conducting holes 35 of the connector 30 and the air conducting apertures 22 of the bushing 20 into the flow conduit 21 of the bushing 20 to break the vacuum state in the shower head and to perturb the water flow in the shower head so as to produce a turbulent flow in the shower head so that the water flow injected from the nozzle 40 is broken and divided into multiple straight water beams and multiple irregular water bubbles so as to increase the flushing angle and area of the shower head.

Accordingly, when the water flows through the shower head, the ambient air is introduced through the air conducting holes 35 of the connector 30 and the air conducting apertures 22 of the bushing 20 into the flow conduit 21 of the bushing 20 to break the vacuum state in the shower head and to perturb the water flow in the shower head so as to produce a turbulent flow in the shower head so that the water flow injected from the nozzle 40 is broken and divided into multiple straight water beams and multiple irregular water bubbles so as to increase the flushing angle and area of the shower head and to enhance the water flushing effect of the shower head. In addition, the ambient air is introduced through the air conducting holes 35 of the connector 30 and the air conducting apertures 22 of the bushing 20 into the flow conduit 21 of the bushing 20 to reduce the water pressure in the shower head so that the water is injected from the nozzle 40 smoothly and stably so as to provide a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shower head, comprising:

a nozzle;

a connector mounted on an open top of the nozzle;

a sealing ring mounted in the open top of the nozzle and located between the connector and the nozzle;

a fastening member secured on the open top of the nozzle and abutting the connector to limit the connector on the nozzle;

a bushing mounted in the connector;

wherein the open top of the nozzle has an inner portion formed with an inner threaded portion;

the connector has a first end provided with a spherical body rotatably mounted on the open top of the nozzle and abutting the sealing ring;

the connector has a second end provided with a threaded tube;

the connector has an inner portion formed with a flow channel;

the flow channel of the connector has a peripheral wall formed with two radially opposite limit portions;

the connector has a peripheral wall formed with two radially opposite air conducting holes;

the air conducting holes of the connector are connected to the flow channel;

the fastening member has an outer wall formed with an outer threaded portion screwed into the inner threaded portion of the nozzle;

the fastening member has an inner wall having a top formed with a limit hole mounted on the spherical body of the connector;

the bushing is received in the flow channel of the connector;

the bushing has an outer wall formed with two radially opposite locking portions locked in the limit portions of the connector respectively;

the bushing has an inner wall formed with a flow conduit connected to the flow channel of the connector;

the bushing has a peripheral wall formed with two radially opposite air conducting apertures aligning with the air conducting holes of the connector respectively;

the air conducting apertures of the bushing are connected to the flow conduit.

2. The shower head of claim 1, wherein the shower head further comprises an O-ring mounted on the outer wall of the bushing and located in the flow channel of the connector;

the O-ring is pressed between the bushing and the connector to provide an air-tight effect between the bushing and the connector;

the bushing is a hollow stepped cylinder;

the flow conduit of the bushing extends axially through the bushing;

the flow conduit of the bushing is connected between the flow channel and the water outlet of the connector;

the flow conduit of the bushing has a circular shape.

3. The shower head of claim 1, wherein the flow channel of the connector has a bottom formed with a reduced water outlet which has a diameter smaller than that of the flow channel;

the flow channel of the connector extends axially through the connector;

the air conducting holes of the connector are formed in a peripheral wall of the threaded tube of the connector.

4. The shower head of claim 1, wherein each of the locking portions of the bushing is an elongate rib which extends axially on the bushing;

each of the limit portions of the connector is an elongate slot which extends axially in the flow channel of the connector.

5. The shower head of claim 1, wherein the flow conduit of the bushing has an upper end formed with an inner threaded section;

the shower head further comprises a top cover secured in the flow conduit of the bushing to seal the flow conduit of the bushing;

the top cover has a first end provided with a threaded disk screwed into the inner threaded section of the bushing;

the top cover has a second end provided with a flow tube which is extended into the flow conduit of the bushing;

the top cover has an inner portion formed with a through hole which is connected between the flow channel of the connector and the flow conduit of the bushing;

the through hole of the top cover extends axially through the threaded disk and the flow tube of the top cover;

the top cover has a top face formed with an elongate tool insertion slit.

* * * * *